United States Patent [19]

Koshikawa et al.

[11] 4,250,945

[45] Feb. 17, 1981

[54] METHOD OF SEQUENTIAL CONTINUOUS-CASTING OF DIFFERENT GRADES OF STEEL

[75] Inventors: Takao Koshikawa; Tunehiro Ueda; Katsuji Fukushima, all of Chiba, Japan

[73] Assignee: Kawasaki Steel Corporation, Kobe, Japan

[21] Appl. No.: 49,881

[22] Filed: Jun. 19, 1979

[30] Foreign Application Priority Data

Jun. 20, 1978 [JP] Japan ..... 53-75031

[51] Int. Cl.[3] ..... B22D 11/00

[52] U.S. Cl. ..... 164/86; 164/82

[58] Field of Search ..... 164/425, 445, 86, 82

[56] References Cited

U.S. PATENT DOCUMENTS 3,789,911 2/1974 Bachner ..... 164/445

FOREIGN PATENT DOCUMENTS 51-112431 10/1976 Japan ..... 164/82

*Primary Examiner*—Robert D. Baldwin

*Assistant Examiner*—K. Y. Lin

*Attorney, Agent, or Firm*—Koda and Androlia

[57] ABSTRACT

The method of sequential continuous-casting of the different grades of steel according to the present invention comprises the steps of: stopping the pouring of a first grade of molten steel into a mold; immersing a cooling material consisting of a steel structure slightly smaller than the inner cross-sectional area of the mold by way of guiding jigs fastened to said cooling material; forming a solidified phase around said cooling material; and merging said solidified phase in a solidified shell developed from the wall of the mold to form a solidified layer shutting the upper portion off the lower portion of the first grade of molten steel. According to the method, the pouring the second grade of molten steel is started before the solidifed layer for shutting the upper portion off the lower portion of the first grade of molten steel as described above and the surface of the first grade of molten steel is solidified completely, and at the same time, the drawing of the cast slab is started again and the change-over to the normal continuous casting of the second grade of molten steel is effected.

8 Claims, 8 Drawing Figures

METHOD OF SEQUENTIAL CONTINUOUS-CASTING OF DIFFERENT GRADES OF STEEL

BACKGROUND OF THE INVENTION (1) Field of the Invention

The present invention relates to a method of sequential continuous-casting of different grades of steel, and particularly to a method of sequential continuous-casting of different grades of steel wherein cutting loss at the joint portion is very low and the workability of the process is excellent.

(2) Description of the Prior Art

In the case of casting different grades of molten steel by continuous process, heretofore, in general, there has been adopted such a procedure that, upon completion of continuous casting of one grade of molten steel, continuous casting of another grade of molten steel cannot be started until the preparatory working for continuous casting has been performed all over again. However, the period of time required for the preparatory working for continuous casting usually amounts to 60 to 90 minutes, it has not been avoidable that the casting efficiency is reduced to a considerable extent in the case of conventional operating process for the different grades of molten steel.

In the case of changing over from the continuous casting of a first grade of molten steel to a second grade of molten steel that are different in constituent from each other, if the second grade of molten steel which is different in constituent from the first is successively poured into the mold by the conventional method without resorting to any appropriate measure, it has been known the fact that mixing is effected between the different grades of molten steel, suction caused by solidification shrinkage and bulging, and diffusion of the molten steel and convention by the difference in temperature, thus resulting in mixing between different grades of molten steel reaching a depth as deep as five to eight meters from the liquid level in a mold. As the result of said mixing action, such a cast slab in which different grades of molten steel are mixed together is formed in the boundary area between two grades of cast slab which cannot be used as either grade of steel and therefore should be scrapped, thus significantly decreasing the yield of molten steel. Heretofore, there have been proposed various processes for minimizing production of such mixed cast slab.

According to the invention described in the publication of Japanese Patent Application Laid-Open No. 57921/75 representing one of the typical processes, it is intended that the connecting function to connect the different grades of cast slab to each other is performed by a connecting material such as H-steel, and the mixing occurring between the different grades of cast slab is completely shut off by charging a coolant material such as nail scrap. However, according to this method, although these are slight differences depending on the types of continuous casting machines used, the tensile load imposed on the connecting material can reach 30 to 100 tons. Hence, even if the connecting material is divided in use, the weight of the material thus divided exceeds 30 Kg which is inconvenient in handling. And, to draw the first grade of cast slab which is continuously cast later, the drawing force is imparted to said cast slab through the connecting material connected to the lower portion of said cast slab and the first grade of cast slab connected to said connecting material. Consequently, it becomes necessary to make the end portions of the respective grades of cast slab be solidified completely. To attain such solidification, there are presented such disadvantages that the period of time required for treatment should be extended by three to ten minutes, and moreover, such a possibility is very high that due to notch effect breakdown occurs in a solidified shell caused to the joint portion of the connecting material interposed between the different grades of cast slabs to which said drawing force is imparted, and in turn the joint portion is broken, to thereby allow the molten steel cast to flow downwardly from the water-cooled mold.

Other examples of the prior art are disclosed in the publications of Japanese Patent Application Laid-Open Nos. 112431/76 and 30723/77, for example. These conventional techniques contemplate that one or more stages of partition plates, the center portion of which is open are arranged on the upper surface of the first grade of molten steel, and the second grade of molten steel is poured onto said partition plate or plates to thereby partition the second grade of molten steel off the first grade of molten steel. By this, the purpose has been attained to a certain extent and the cast slab in which the different grades of steel are mixed could be reduced to as short as about one meter. However, in these conventional techniques, as the partition plate or plates have the open center portions, partial mixing between the different grades of molten steel cannot be prevented from occurring, and the best result obtainable by this technique is to shorten the scope of the mixed cast slab to one meter. Further, according to these conventional techniques, there is presented such a disadvantage that, since the partition plate or plates are mounted on the upper surface of the first grade of molten steel, a solidified shell produced in the mold may be broken at a portion of said partition plate or plates, thus resulting in the so-called break-out, i.e. the molten steel leaking out of said portion when the cast slab is drawn.

SUMMARY OF THE INVENTION

The object of the present invention is to obviate the disadvantages of the prior art and provide a method of sequential continuous-casting of different grades of steel wherein cutting loss at joint portions is very low and the workability of the method is excellent.

Other objects and features of the present invention will become apparent more fully from the description of the following embodiment in conjunction with the accompanying drawings. However, the accompanying drawings are intended for explanation only, but not for restricting the scope of the invention.

The abovedescribed objects of the present invention can be achieved by the present invention, the technical gist of which resides in the following.

Namely, in a method of sequential continuous-casting wherein the continuous casting of the first grade of molten steel is changed over to the continuous casting method of the second grade of molten steel, the former and the latter being different in constituent, said continuous casting method comprises the steps of:

stopping the pouring the first grade of molten steel into the mold;

immersing a cooling material into the first grade of molten steel at the substantially center portion of said mold;

forming a solidified layer merging in a solidified shell developed from the wall of said mold and around said cooling material; and pouring the second grade of molten steel into said mold before the upper surface of the first grade of molten steel on the top of said cooling material is solidified.

DETAILED DESCRIPTION OF THE INVENTION

Figure 1:
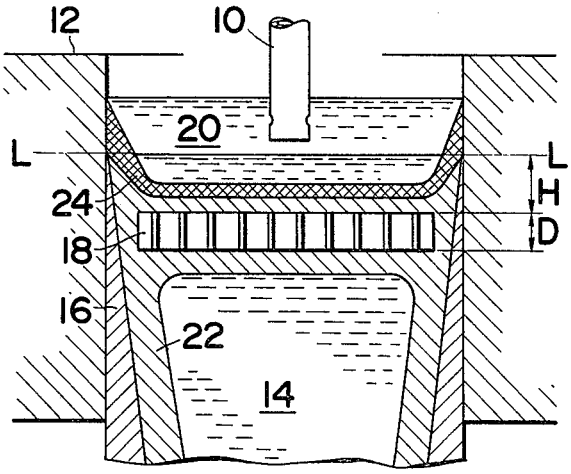
FIG. 1 is a schematic longitudinal sectional view showing the solidified conditions of the first and second grades of molten steel in the mold when the lattic-shaped cooling material embodying the present invention is used.
Figure 3A:
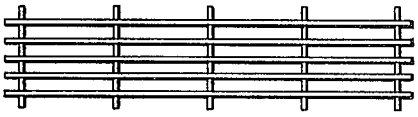
FIGS. 3A, 3B, 3C and 3D are schematic plan views showing the embodiments of cooling materials according to the present invention.
Figure 3B:
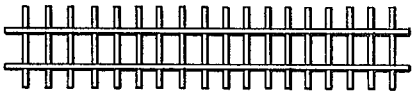
Figure 3C:
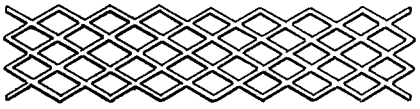
Figure 3D:
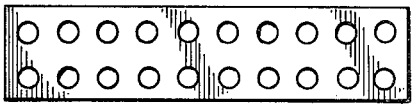

Description will hereunder be given of the details of the present invention and one embodiment thereof with reference to the accompanying drawings. The pouring of the first grade of molten steel 14 being continuously cast previously from the tundish through the immersion nozzle 10 into the mold 12 is stopped and sumultaneously the drawing of the first grade of cast slab is also stopped. At this time, in the first grade of molten steel 14 in the mold 12, a solidified shell 16 of the first grade of cast slab is formed at the wall of mold.

Figure 4:
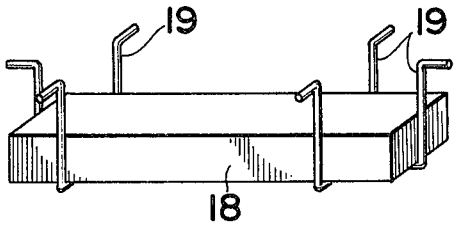
FIG. 4 is an oblique view showing the cooling material equipped with guiding jigs according to the present invention.

Upon stopping the pouring of the first grade of molten steel 14, a cooling material 18 is immersed and embedded in the first grade of molten steel 14 in the mold 12 as shown in FIG. 4. Then the first molten steel 14 around the colling material 18 is partially, rapidly cooled, a solidified shell 22 is formed thereat, which is merged in the previously formed solidified shell 16, whereby the upper portion is shut off from the lower portion, to thereby form a provisional bottom for receiving the second grade of molten steel 20.

Figure 2:
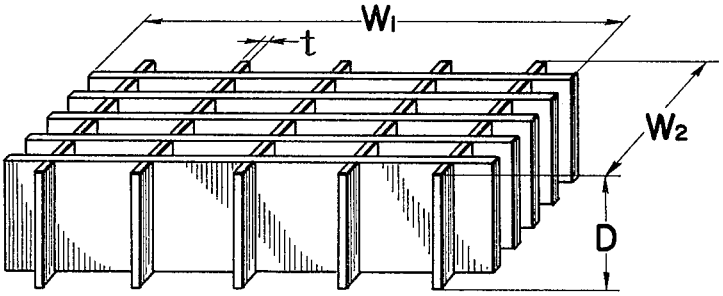
FIG. 2 is an oblique view showing the main body of a lattice-shaped cooling material embodying the present invention.

It has been found that, as the cooling material used in accordance with the present invention, it is preferable to use a steel structure having a plurality of vacant spaces allowing the molten steel in the mold to pass vertically therethrough, such for example as the lattice eye-shaped steel structure as shown in FIG. 2. In addition, as for the cooling materials used in accordance with the present invention, there may be preferably used the cooling material having a plurality of vacant spaces of one or more types selected from among the vacant spaces of net-eye shape, rectangular-eye shape, triangular-eye shape, polygonal-eye-shape, circular-eye shape, elliptic-eye shape, star-eye shape and others in addition to the lattice-eye shape. These cooling materials are preferably each disposed in a planar fashion in the molten steel contained in the mold. It is preferable to select the height of the cooling material from the top surface to the bottom surface to be 40 mm and more so as to allow the molten steel poured into the mold to pass through the vacant spaces of the cooling material as substantially vertical and unidirectional currents. Furthermore, it is necessary that the thickness of the wall between one vacant space and the adjacent vacant space, i.e., the wall thickness of the cooling material has such a value that the cooling material is not melted by the molten steel, and it is preferable to have a thickness of 2 to 20 mm practically.

Additionally, according to the present invention, the depth of the cooling material being immersed and embedded in the molten steel contained in the mold is preferably large so as to secure the connecting strength by the use of the cooling material between the solidified cast slab of the first grade of molten steel previously poured in and the solidified cast slab of the second grade of molten steel poured in later. However, in the case the depth is excessively large, if the closing of the vacant spaces by the solidified phase is incomplete, the different grades of molten steel are mixed with each other, whereby the zone of the mixed and solidified cast slab is increased in size, which portion must be cut off later, thus decreasing the yield. Consequently, as viewed from the connecting strength, it is desirable to immerse the cooling material at least 50 mm in depth.

Description will hereunder be given of the connecting mechanism from the first grade of molten steel to the second grade of molten steel in the use of the cooling material of the type described.

Upon completion of casting the first grade of molten steel 14 poured through an immersion nozzle 10 and cast, the cooling material 18 provided therein with a multiplicity of vacant spaces and having the height D from the top surface to the bottom surface in accordance with the present invention is immersed into the first grade of molten steel 14 to the depth H of about 50 mm from the upper liquid level L—L. The instant the cooling material 18 is immersed, the first grade of molten steel 14 which has entered the vacant spaces of the cooling material 18 and the first grade of molten steel 14 around the cooling material 18 start to be cooled, and a solidified phase 22 is formed to be merged in the solidifying shell 16 which has been formed at the inner wall of the mold 12. Thus, the vacant spaces of the cooling material 18 are clogged and the solidified phase 22 which has been produced around the clogged vacant spaces is merged in the solidifying shell 16 produced at the inner wall of the mold 12, whereby the upper portion of the first grade of molten steel is shut off, an unsolidified phase of the first grade of molten steel 14 still exists below a shut-off layer including said cooling material, and an unsolidified phase of the first grade of molten steel 14 exists above the shut-off layer.

Pouring of the second grade of molten steel 20 is started under the abovedescribed condition, namely, before the outer surface of the first grade of molten steel 14 is solidified which remains on the top of the shut-off layer consisting of a solidified phase having said cooling material 18 as the core material thereof. It is only two to three minutes from the completion of pouring the first grade of molten steel to the start of pouring the second grade of molten steel 20.

Even if the pouring of the second grade of molten steel 20 is started before the vacant spaces of the cooling material 18 are not clogged or part of the solidified phase 22 is broken which is clogging the vacant spaces of the cooling material 18 through the action of attracting force caused by the shrinkage of the first grade of molten steel 14 due to the solidification, the vacant spaces of the cooling material 18 are only vertically penetratingly provided, whereby the second grade of molten steel 20 passes through the vacant spaces as downwardly parallelly dispersed currents, so that the mixing with the first grade of molten steel 14 can be restricted to the minimum.

Even if the pouring of the second grade of molten metal 20 is started as described above, the mixing with the first grade of molten steel 14 can be restricted to the minimum extent, a solidified phase 24 in which the first grade of molten steel 14 and the second grade of molten steel 20 are mixed to the minimum extent is formed on the solidified phase 22 of the first grade of molten steel 14, and thereafter, drawing is started again.

When the drawing is started again after the second grade of molten steel 20 is poured, the connection at the lowest limit can be maintained by the connecting strength of the boundary portion between said level L—L and the upper end line of the cooling material 18, i.e., between the solidified phases 22 and 24 disposed in a zone ranging from the level L—L to the depth H. According to the present invention, all of the solidified phases surrounding the cooling material 18 are integrated, and hence, the first grade of molten steel 14 on the top of the cooling material 18 is firmly connected to the second grade of molten steel 20. As the time further lapses, still higher connecting mechanism becomes obtainable in the whole cross section of the mold.

FIGS. 3A, 3B, 3C and 3D illustrate several types of cooling materials according to the present invention.

In addition, it is convenient to install cooling material guiding jigs 19 as shown in FIG. 4 on the cooling materials 18 so as to facilitate the immersion of the cooling material 18 into the mold 12 and to stably hold the position of the cooling material 18 in the horizontal direction during immersion.

Description will hereunder be given of the embodiment of the present invention.

EXAMPLE

Two grades of molten steel including A-grade of molten steel and B-grade of molten steel, the chemical compositions of which are shown in Table 1, were continuously cast by use of a continuous casting machine having a first and a second strands in accordance with the present invention. In addition, for the cooling material, one illustrated in an oblique view of FIG. 2 was used. Table 2 shows the results. Furthermore, the symbols indicating the data of the cooling material as shown in Table 2 correspond to those shown in FIG. 2.

TABLE 1

| Grade of steel | Chemical composition (wt. %) | | | |
|---|---|---|---|---|
| | C | Si | Mn | total Al |
| A | 0.14 | 0.18 | 0.76 | 0.006 |
| B | 0.12 | 0.18 | 0.93 | 0.039 |

TABLE 2

| | First strand | Second strand |
|---|---|---|
| Size of slab | 200 mm × 1570 mm | 200 mm × 1570 mm |
| Shut-off cooling material | As shown in FIG. 2 | As shown in FIG. 2 |
| $W_2 \times W_1$ | 140 mm × 1490 mm | 140 mm × 1490 mm |
| Thickness t | 4.5 mm | 4.5 mm |
| Height D | 90 mm | 100 mm |
| Total weight | 39 Kg | 30 Kg |
| Work procedure & required time | | |
| Completion of casting grade-A steel (stop of draw) ~ Immersing cooling material | 20 sec | 20 sec |
| Stop of draw ~ Start of pouring grade-B steel | 120 sec | 120 sec |
| Stop of draw ~ Strand draw restart | 140 sec | 135 sec |

Additionally, since the cooling material shown in Table 2 weighs over 30 Kg, it was divided into two parts in use. Further, to hold the cooling material at the embedded depth H (corresponding to H in FIG. 1) which is about 150 mm and to align the cooling material with the center portion of the shell in the mold, guiding jigs 19 as shown in FIG. 4 were fastened to the cooling material 18.

Figure 5:
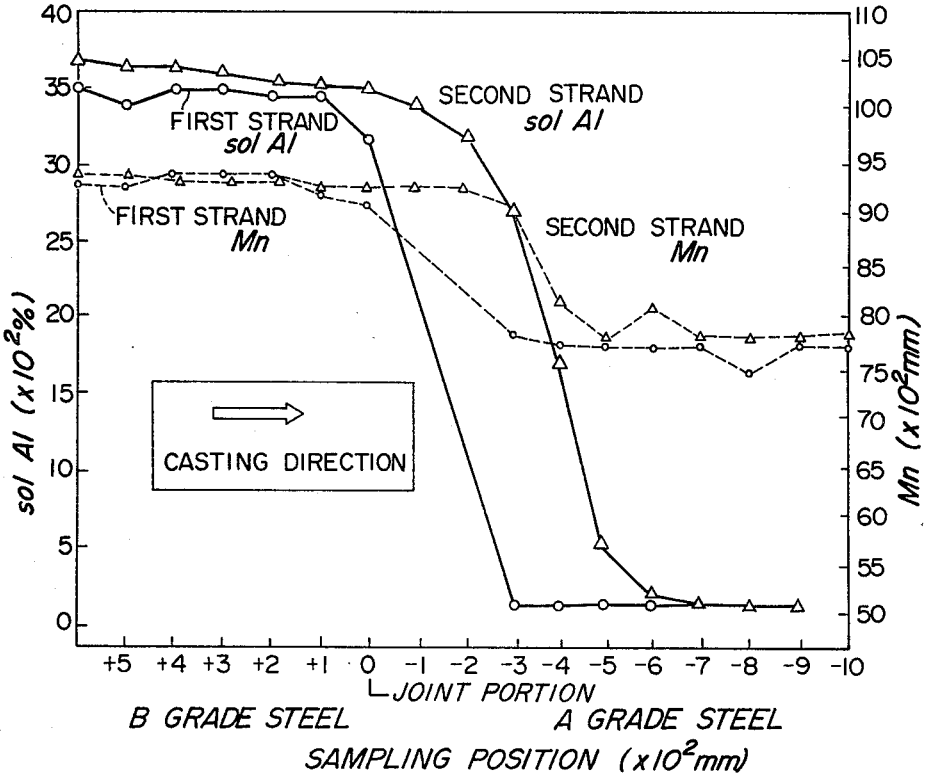
FIG. 5 is a correlational diagram showing the changes in concentration of manganese and soluble aluminum at the portions above and below the cooling materials as in an embodiment of the mixed conditions of the different grades of steel according to the present invention.

To study the mixing conditions of molten steel in this embodiment, a sample of the slab was cut out which extends 1000 mm in length in the drawing direction, i.e., on the side of grade-A steel and also extends 600 mm in length in the direction opposite to the drawing direction, i.e., on the side of grade-B steel as referenced from the boundary where the different grades of steel are connected to each other, divided into two at the center line of the width of the slab, and further, a drill sample is picked up at the center line of the thickness of the slab. One example of the results is shown in FIG. 5. From the drawing, it was found that, in the first strand, the mixing was shut off 300 mm below the undersurface of the cooling material, and in the second strand, the mixing was shut off 700 mm below the undersurface of the cooling material. As compared with the natural mixing which is 5 to 8 m, the mixing according to the present invention was reduced by substantially one tenth. Furthermore, as for the strength of the joint portion, there was encountered no problem, and no cracking was seen in the joint portion.

As apparent from the above embodiment, according to the present invention, in continuously casting the different grades of molten steel, upon stopping the pouring of the first grade of molten steel at first, the cooling material having the guiding jigs slightly smaller in cross section than the mold is immersed in the center portion of the mold so as to form a solidified phase around said cooling material, whereby said solidified phase is integrally connected to a solidified shell of the first grade of molten steel formed on the inner wall of the mold, thereby forming a shut-off layer for shutting the upper portion off the lower portion in the intermediate portion of the first grade of molten steel in the mold. Thereafter, the second grade of molten steel different in constituent from the first grade of molten steel is poured in before the upper surface of the first grade of molten steel disposed on the top of shut-off layer formed as described above. As the result, the second grade of molten steel forms a solidified phase on the top of a solidified phase of the first grade of molten steel formed around said cooling material, and at the same time, forms newly a solidified shell thereof on the top of a solidified shell of the first grade of molten steel on the inner surface of the mold, which integrally connected to the solidified phase of the second grade of molten steel formed around the cooling material, whereby the mixing with the first grade of molten steel is restricted to the minimum, thus enabling to restart the drawing.

Even if the drawing of the cast slab is started again, the solidified phase of the first grade of molten steel surrounding the cooling material, the solidified phase integrally connected to the top of said solidified phase and the solidified shell of the second grade of molten steel laminated on the top of the solidified shell of the first grade of molten steel formed on the inner wall of the mold are all integrally, firmly connected and descend, so that such a trouble can be avoided that the molten steel leaks out due to the break in the joint portion, which is called break-out, thus allowing the different grades of cast slab jointed with the second grade of steel to be smoothly drawn off and descend.

Furthermore, in the case such a cooling material is used which has a plurality of vacant spaces through which the molten steel as described in the embodiment can pass only in the vertical direction, even if the timing of pouring the second grade of molten steel is too early, said vacant spaces are not yet clogged due to the suction caused by shrinkage when the first grade of molten steel is solidified or the pouring is started again when the solidified shell is broken, the mixing with the first grade of molten steel can be avoided to the minimum because the flow of the second grade of molten steel is only downwardly directed and parallelly divided.

Further, in the process of continuously casting the different grades of molten steel according to the present invention, only three minutes of interruption in pouring molten steel is required, the workability in the change-over work is excellent. In addition to the above, since the mixing portion of the different grade of molten steel is as short as about 30~50 cm in the joint portion between the different grades of molten steel, the cast slab cut-off portion at the joint is as short as about 50 to 70 cm, thus presenting such an advantage that the yields of molten steel and cast slab can be significantly improved.

What is claimed is:

1. A method of sequential continuous-casting wherein continuous casting of a first grade of molten steel is changed over to continuous casting of a second grade of molten steel different in constituent from the first grade of molten steel, comprising the steps of:

stopping the pouring of the first grade of molten steel into a mold;

immersing a steel structure having a plurality of vacant spaces for allowing the molten steel in said mold to pass vertically therethrough in the substantially center portion of the first grade of molten steel in said mold;

forming around said steel structure a solidified layer merging in a solidified shell developed from the wall of said mold; and pouring the second grade of molten steel into said mold before the surface of the first grade of molten steel above said steel structure is solidified.

2. A method of sequential continuous-casting of the different grades of molten steel as set forth in claim 1, wherein said cooling material is a steel structure having lattice-eye-shaped vacant spaces.

3. A method of sequential continuous-casting of the different grades of molten steel as set forth in claim 1, wherein said cooling material is a steel structure having triangular-eye-shaped vacant spaces.

4. A method of sequential continuous-casting of the different types of molten steel as set forth in claim 1, wherein said cooling material is a steel structure having polygonal-eye-shaped vacant spaces.

5. A method of sequential continuous-casting of the different types of molten steel as set forth in claim 1, wherein said cooling material is a steel structure having circular-eye-shaped vacant spaces.

6. A method of sequential continuous-casting of the different grades of molten steel as set forth in claim 1, wherein said cooling material is a steel structure having elliptic-eye-shaped vacant spaces.

7. A method of sequential continuous-casting of the different grades of molten steel as set forth in claim 1, wherein the wall thickness of said cooling material is 2 to 20 mm.

8. A method of sequential continuous-casting of the different grades of molten steel as set forth in claim 1 wherein the depth of immersing and embedding said cooling material in the first grade of molten steel in said mold is 50 mm or more as measured from the top of said cooling material.

* * * * *